United States Patent [19]

Lacan

[11] 4,006,960

[45] Feb. 8, 1977

[54] MEMBER FOR CONNECTING THE END OF A CONDUCTOR TO A PIN

[75] Inventor: Guy Lacan, Carrieres sous Bois, France

[73] Assignee: La Telemecanique Electrique, France

[22] Filed: May 6, 1975

[21] Appl. No.: 575,116

[30] Foreign Application Priority Data

May 15, 1974 France ..... 74.16811

[52] U.S. Cl. ..... 339/274

[51] Int. Cl.[2] ..... H01R 9/12

[58] Field of Search ..... 339/95, 205, 256, 258, 339/273, 274

[56] References Cited

UNITED STATES PATENTS 3,045,205 7/1962 Osborn ..... 339/256 R 3,821,693 6/1974 Dechelette ..... 339/256 R

FOREIGN PATENTS OR APPLICATIONS 1,109,940 4/1968 United Kingdom ..... 339/256 R

*Primary Examiner*—Joseph H. McGlynn

*Attorney, Agent, or Firm*—William Anthony Drucker

[57] ABSTRACT

The present invention relates to a member for connecting a conductor to a pin.

It comprises an insulating sleeve surrounding a prismatic metal casing within which a tongue defines two recesses for the pin and conductor respectively, whereby the securing of the latter results from the introduction of the former.

The invention can be applied to cabling devices, notably those using systems of parallel pins.

6 Claims, 6 Drawing Figures

MEMBER FOR CONNECTING THE END OF A CONDUCTOR TO A PIN

The invention relates to a member for connecting the end of a conductor to a metal pin, said member comprising an insulating sleeve wherein is arranged a metallic member having two walls between which are positioned the ends of the conductor and of the pin which are introduced through openings at opposite ends of the said sleeve.

Such members can in particular be used in detachable electrical connection systems where the pins are arranged in lines and columns which are separated by only a small spacing.

Devices of the type described hereinbefore are already known, for example from French Pat. No. 2,174,358. In this known device the pin has a rectangular cross-section and is connected to the end of a solid conductor. The shape and dimensions of the resilient member as well as its operating mode were designed so as to take account of this information in such a way that this known device is not applicable to the case where the pin has a square or round cross-section and where the conductor comprises a plurality of pins. Moreover, it is intended for use in equipment where the pins are relatively widely spaced and does not permit the connection of several conductors to the same pin due to the fact that the conductor introduction opening is very close to the pin axis. Finally, the extraction of the device requires the use of a tool which, despite its simplicity calls for a relatively large gap between the pins.

Therefore the invention proposes to provide a connecting member which can be used in systems of parallel, round or prismatic pins having only a limited spacing therebetween whilst permitting the fitting of several of the said members on one and the same pin and in accordance with different orientations.

A further object of the invention is to provide a connecting member which is able to connect the end of a conductor comprising a metal core which is either solid or formed from a plurality of wires, despite the dimensional tolerances of the conductor.

It is a further object to provide a connecting member which can be fitted and removed without using a tool and which can be positioned at the end of the conductor prior to fitting.

Other advantageous features will be apparent from the following description with reference to the drawings, wherein.

Figure 1:
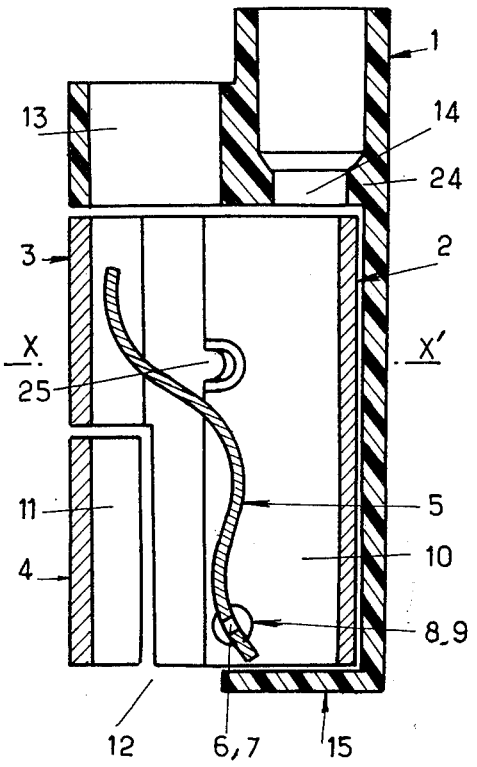
FIG. 1 is a longitudinal sectional view of a connecting member, without pin and conductor, taken on the line Y–Y′ in FIG. 2.
Figure 2:
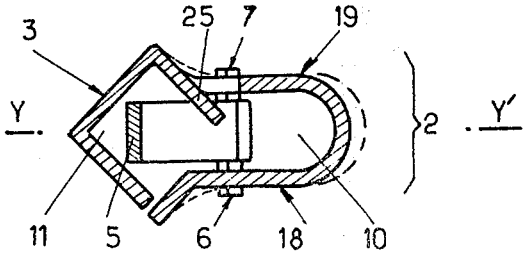
FIG. 2 is a cross-section of a casing in FIG. 1 taken on the line X–X′ of FIG. 1.
Figure 3:
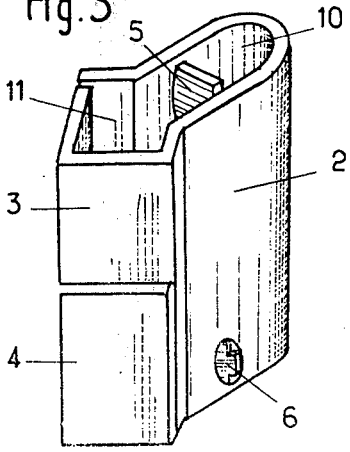
FIG. 3 is a perspective view of the casing.

In FIG. 1, 1 is a plastic sleeve having a recess for receiving a casing 2 produced by bending a previously cut resilient metallic sheet. The general shape of the casing can be seen in FIG. 3 where it can be seen that the casing is not totally sealed but has a gap produced by bending two tabs 3, 4 which are fitted one above the other and give the casing a prismatic shape whose section is shown in FIG. 2.

Within the casing is longitudinally arranged a contact tongue 5 whose length is similar to that of the casing and which has a sinuous longitudinal configuration. This tongue is mounted in the casing by two pivots 6 and 7 which engage into two openings 8 and 9 in the casing walls at its lower region.

The presence of this tongue defines two recesses 10 and 11 within the casing. Recess 11 is aligned with a gap 12 and an opening 13 in sleeve 1 whilst recess 10 is positioned facing a third opening 14 and a wall 15 of the said sleeve. Recess 10 serves to receive the end 16 of a conductor 17 whose sheath enters into a broader portion of opening 14, cf. FIG. 4. The limitation of entry of the conductor is obtained by the conductor striking against wall 15 or by its sheath 26 striking against a flange 24 in the sleeve. Recess 11 is shaped so as to receive a pin such as 19 which abuts laterally one of the undulations 20, 21 of tongue 5 in order to displace the latter towards the right. When undulation 22 in tongue 5 strikes the end 16 of the conductor, and the tongue 5 is accordingly resiliently deformed. Alternately, if the tongue is stiffer than the casing the casing resiliently deforms so as to permit the passage of the pin.

Figure 4:
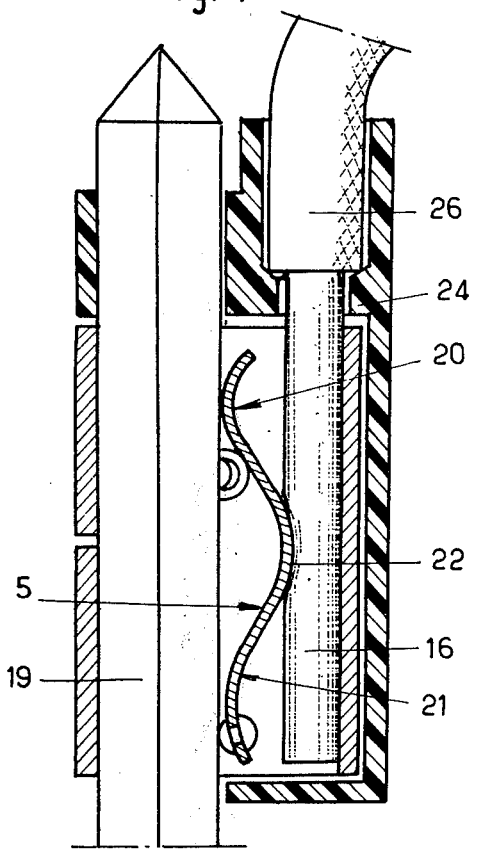
FIG. 4 is a section of the device fitted to a pin and equipped with a conductor.

In both cases there is obtained a simultaneous tightening or jamming of conductor and pin against the casing because the sum of the transverse dimensions of pin, tongue and conductor are slightly greater than the maximum transverse dimension of the casing, as can be seen in FIG. 4.

Figure 5:
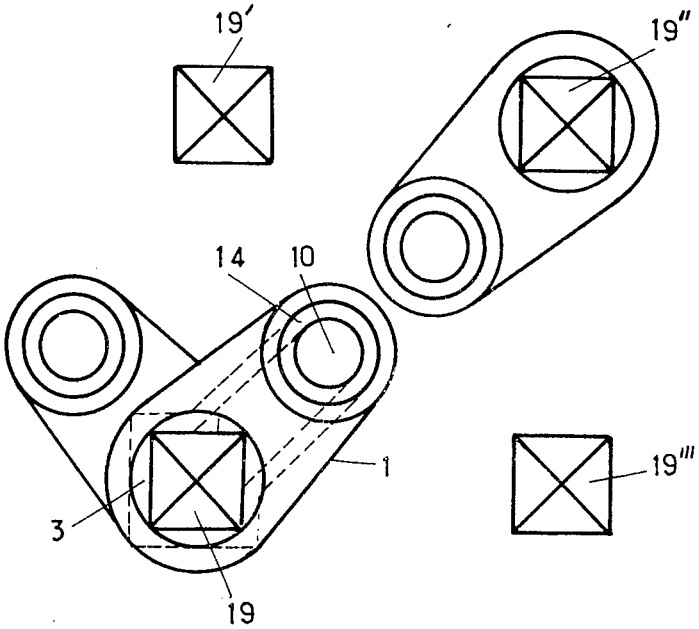
FIG. 5 is a plan view of the connecting member.

When it is proposed to fit the connecting members on pins 19, 19′, 19″, 19‴ having a square cross-section and having only a limited spacing therebetween, it is necessary to arrange each connecting member in such a way as to be are directed towards one of the most remote pin as shown in FIG. 5. For this purpose the casing has been given such a shape that recess 11 which receives the pin has a portion of square cross-section one of the diagonals of which passes through the second recess, as can be seen in FIGS. 2 and 5. The stability of the thus defined position depends on the resilient deformation properties given to the casing by tabs 3 and 4. Moreover, it can be seen that the cross-section of the casing decreases in the region defining recess 10 in such a way that a lateral deformation of the casing is possible when the pin is fitted, as indicated by the dotted lines in FIG. 2.

When it is desired to use the connecting member the end 16 of the conductor is positioned in recess 10 and it is then necessary to maintain it in this position. This is obtained by providing at least one of the lateral walls 18, 19 of the casing with a detent 25 obtained by cutting the wall and deforming a portion of it inwardly adjacent to tongue 5, cf. fig. 2. In order to secure the end of the conductor the tongue must be moved towards the conductor until the tongue latches behind the detent, thus bringing about a prior gripping of the said end. The tongue can be moved by means of an instrument introduced in place of the pin and then subsequently removed.

As sleeve 1 has an opening 13 in its upper portion, it is possible to engage the connecting member onto a pin and slide it down the pin in order to permit other connecting members to be fitted onto the same pin in stacked formation.

In the case where several members are fitted on the same pin, it is recommended that they should be given different orientations to avoid too great a bending of one of the conductors, cf. FIG. 5.

Figure 6:
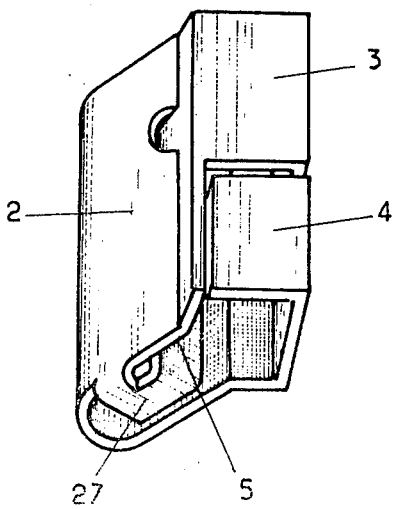
FIG. 6 shows a variant in perspective view.

In the variant shown in FIG. 6 the tongue is formed by bending up an integral portion 27 of the casing the displacements of said portion being obtained by bending of the portion and not from a pivoting movement as in the previous embodiment. It is also possible for the tongue to be fixed to a portion of the sleeve adjacent to the region where entry of the pin takes place. This fixing as well as the connection between casing and sleeve can be obtained by a moulding operation.

I claim:

1. An electrical connecting member, for connecting an end portion of a first conductor electrically with a second conductor, comprising:

i. a sleeve of insulating material, said sleeve having an opening to receive said first conductor;

ii. an elongated casing disposed in said sleeve and having a first open end adjacent the sleeve opening and a second opposed open end;

iii. an elongated tongue within the casing mounted thereto only at one extremity adjacent one open end and extending towards the other open end, said tongue being free at its other extremity and defining in said casing a first recess at one side of the tongue to receive said first conductor, said tongue defining in said casing a second parallel recess at the other side of said tongue to receive said second conductor parallel to said first conductor, said tongue being of normally undulant shape along its length so as to occupy a space greater than the spacing between said first and second conductors when they are disposed respectively in said first and second recesses, said tongue being resiliently deformable in to permit introduction of said first and second conductors into said casing, whereby said tongue is urged into abutment with said first and second conductors to provide electrical connection between them.

2. An electrical connecting member, as claimed in claim 1, wherein said tongue is mounted in said casing by a pivot.

3. An electrical connecting member, as claimed in claim 1, wherein said extremity of the tongue is integral with said casing.

4. An electrical connecting member, as claimed in claim 1, wherein said second recess has a substantially square crosssection, a diagonal of which, when extended, passes through the median axis of said first recess.

5. An electrical connecting member, as claimed in claim 1, comprising a detent disposed in said casing and positioned such that with said first conductor positioned in said first recess, said tongue may be moved to abut said first conductor and then resiliently deformed and engaged with said detent to retain said tongue in said resiliently deformed abutting condition.

6. An electrical connecting member, as claimed in claim 1, wherein said casing is formed of sheet metal and includes two tab portions which together with said tongue, define said second recess.

* * * * *